United States Patent [19]

Yamaguchi

[11] 4,040,838

[45] Aug. 9, 1977

[54] PROCESSING COLOR PHOTOGRAPHIC MATERIALS

[75] Inventor: Seiya Yamaguchi, Minami-ashigara, Japan

[73] Assignee: Fuji Photo Film Co., Ltd., Minami-ashigara, Japan

[21] Appl. No.: 664,225

[22] Filed: Mar. 5, 1976

[30] Foreign Application Priority Data

Mar. 5, 1975 Japan ..... 50-27276

[51] Int. Cl.[2] ..... G03C 5/32

[52] U.S. Cl. ..... 96/60 R; 96/60 BF

[58] Field of Search ..... 96/60, 60 BF, 55

[56] References Cited

U.S. PATENT DOCUMENTS

| | | | |
|---|---|---|---|
| 3,773,510 | 11/1973 | Fisch | 96/60 BF |
| 3,960,565 | 6/1976 | Fisch et al. | 96/60 R |

FOREIGN PATENT DOCUMENTS

| | | | |
|---|---|---|---|
| 1,297,905 | 11/1972 | United Kingdom | 96/60 BF |
| 1,311,001 | 3/1973 | United Kingdom | 96/60 BF |
| 1,131,096 | 10/1968 | United Kingdom | 96/60 BF |

*Primary Examiner*—Mary F. Kelley

*Attorney, Agent, or Firm*—Sughrue, Rothwell, Mion, Zinn and Macpeak

[57] ABSTRACT

In the high temperature color development processing of color photographic materials, the formation of reticulation and scratches on the surfaces of the photographic films is prevented and drying can be performed in a shortened period of time at a high temperature by processing the color photographic materials in a bleach solution or blix solution containing a metal complex of an organic acid, a water soluble ammonium compound and a magnesium compound.

The bleach solution or blix solution does not give rise to environmental pollution and can be easily regenerated for reuse.

15 Claims, No Drawings

PROCESSING COLOR PHOTOGRAPHIC MATERIALS

BACKGROUND OF THE INVENTION

1. Field of the Invention

The present invention relates to processing silver halide photographic materials, more particularly, to hardening color photographic materials with a bleach solution or a blix solution.

2. Description of the Prior Art

To rapidly process color photographic materials, it is generally necessary to process at a temperature higher than 30° C, but in such a case the photographic emulsion layers of photographic materials are apt to be swollen and softened to cause reticulation or are apt to be scratched and peel off during processing. In fact, sometimes the emulsion layers melt during drying after processing. In particular, these faults tend to become more pronounced as the processing temperature is increased, and thus are a great obstacle to practice high temperature rapid processing.

To prevent softening of the emulsion layers of color photographic materials in high temperature processing thereof, a process has hitherto been employed wherein a hardening bath is used during processing or a hardening agent such as alum or formalin is added to another processing bath. The former process is, however, unsuitable for rapid processing since the number of processing steps increases and the time required to complete total processing is prolonged. On the other hand, the latter process is suitable for rapid processing since the number of processing steps and the processing time are the same as those of conventional high temperature processes. The process of this invention belongs to the latter type of processes.

Processing steps for silver halide color photographic materials include as necessary steps a silver removal step for removing silver images after color development. The silver removal step is usually composed of a bleach step and a fix step or a blix step which performs the bleach step and the fix step in one bath. In silver removal, silver formed by development is oxidized by a bleaching agent (oxidizing agent) to silver halide and the silver halide thus formed is converted into a water soluble silver salt by the fixing agent.

As the bleaching agent, potassium ferricyanide, potassium dichromate, and a metal complex salt of an organic acid are usually used. As potassium ferricyanide and potassium dichromate have a high bleaching power, they are used for bleaching color photographic materials containing a large proportion of silver, such as color negative films and color reversal films, but the demand for these materials has recently gradually been reducing due to the difficulty in treating water solutions containing these materials which cause water pollution. On the other hand, a metal complex salt of an organic acid can profitably be used in blix solutions since the complex salts causes less pollution problems and the treatment of waste solution containing such a complex salt is easy, and, further, it can be present together with a fixing agent due to the comparatively weak oxidative power thereof. Further, in the case of using the complex salt, the used processing solution can be easily regenerated by air oxidation for repeated use. Accordingly, metal complex salts of organic acids are widely used as excellent bleaching agents from the viewpoint of causing less pollution problems, simplicity of processing, capability of shortening the processing time and economic profitability.

It is known to incorporate a hardening agent in a bleach solution or a blix solution containing a metal complex salt of an organic acid as a bleaching agent, but with conventional techniques the usable hardening agents are quite limited since the effective pH range of the processing solution is in the weak acid or neutral region of 5.0 to 7.5, and, hence, a hardening agent which can only be used in an acid solution, such as potassium alum or chromium alum, cannot be used. Furthermore, it is also known to add an aldehyde compound such as formaldehyde or glutaraldehyde to such a processing solution, but in such a conventional process it is difficult to add a sufficient amount of the hardening agent to the processing solution to provide to the solution a hardening function which can endure high temperature processing since the addition of such a compound tends to deteriorate the stability of the solution to form precipitates during storage of the solution and has a bad influence on the photographic properties of color photographic materials processed therein to form fog during the storage of processed photographic materials.

SUMMARY OF THE INVENTION

Thus, one object of this invention is to provide a process for preventing swelling and softening of the emulsion layers of color photographic materials in high temperatures processing by providing a hardening function to a bleach solution or a blix solution.

Another object of this invention is to provide a stable bleach solution or blix solution possessing a hardening function.

According to the present invention, there is provided a process of processing color photographic materials which comprises processing silver halide color photographic materials with a bleach solution or a blix solution containing a metal complex salt of an organic acid, a water soluble ammonium compound and a magnesium compound.

As a result of various investigations to provide a sufficient hardening function and stability to a bleach solution or a blix solution containing a metal complex salt of organic acid as a bleaching agent, the inventors found that by adding one or more water soluble ammonium compounds and one or more magnesium compounds to a bleach solution or a blix solution containing one or more metal complex salts of organic acids, a stable bleach solution or blix solution having a hardening function sufficiently durable to high temperature processing and having no bad influence on the photographic properties of color photographic materials can be obtained. It should, however, be noted that the metals, organic acids capable of forming complex salts therewith, water soluble ammonium compounds and magnesium compounds useful in the present invention will easily be appreciated by one skilled in the art, and there is no substantial limitation on such materials hereinafter disclosed.

The bleach solution or blix solution used in the process of this invention containing one or more metal complex salts of an organic acid as a bleaching agent and further containing a hardening component and a stabilization component exhibits a hardening function and, at the same time, improved stability of the solution.

Hereinafter these various components will generally be referred to in the singular for purposes of brevity.

DETAILED DESCRIPTION OF PREFERRED EMBODIMENTS

The magnesium compound used in this invention has the function of hardening the emulsion layers of color photographic materials and the water soluble ammonium compound has the function of maintaining the magnesium compound in the processing solution in a stable manner. That is, the effect of this invention is due to the co-action of these two components and thus the presence of these two components is mandatory.

It is known that a magnesium compound such as magnesium sulfate possesses the effect of hardening an emulsion layer containing gelatin as the vehicle, for example, it is known to harden color negative films by processing in a 3% aqueous solution of magnesium sulfate after color development. However, in the process carbonate or alkali hydroxide in the color developer is carried into the solution of magnesium sulfate by the color photographic films processed, and, hence, fine precipitates of only slightly water soluble magnesium carbonate or magnesium hydroxide are formed, which reduce the hardening power of the solution. The precipitates also attach to the surfaces of the color films and conveyor rolls in the processor and result in scratches on the surfaces of the color films.

If only the magnesium compound is added to the bleach solution or blix solution used in this invention, precipitates of a substantially water insoluble magnesium compound due to the entrance of color developer, etc., form to cause a reduction of the hardening function of the processing solution and the formation of spots and scratches on the surfaces of color films. Therefore, in the process of this invention, a water soluble ammonium compound is added to the bleach solution or blix solution together with the magnesium compound, whereby the formation of precipitates due to color developer, etc., can be prevented, and, furthermore, the formation of precipitates due to carbonate or alkali hydroxide contained in the bleach solution or blix solution can be also prevented and the hardening function and the stability of the processing solution can be maintained.

Water soluble ammonium compounds of the invention can form an ammonium ion in an aqueous solution thereof and include ammonium hydroxide, ammonium salts of inorganic acids and ammonium salts of water soluble organic acids.

Water soluble ammonium compounds which are soluble in water at a solubility of above about 1 g/100 ml of water at 20° C and which have no adverse influence on the photographic properties of color photographic materials and the stability of the processing solution can be used in this invention. Also, the water soluble compounds may be used individually or as a mixture of two or more of such compounds. Examples of the water soluble ammonium compounds used in this invention are ammonium tartarate, ammonium hydrogen tartarate, ammonium benzoate, ammonium borate, ammonium iodide, ammonium bromide, ammonium alum, ammonium bichromate, ammonium carbonate, ammonium chloride, ammonium hydroxide, ammonium persulfate, ammonium sulfide, ammonium thiocyanate, ammonium thiosulfate, ammonium citrate, ammonium formate, ammonium metabisulfite, ammonium bromate, ammonium oxalate, ammonium acetate, ammonium hydrogen carbonate, ammonium sulfite, ammonium nitrate, ammonium sulfate, and aqueous ammonia.

Among these water soluble ammonium compounds, ammonium chloride, ammonium thiosulfate, ammonium acetate, and aqueous ammonia are particularly useful. Ammonium thiosulfate also has functions as a fixing agent and thus is preferably used in a blix solution. Aqueous ammonia is an aqueous solution of ammonia and the solution contains ammonia and ammonium hydroxide.

A proper amount of the water soluble ammonium compound is about 0.05 to about 2 mols per liter of the bleach solution or blix solution.

Magnesium compounds used in the invention are water soluble magnesium compounds having a solubility of not less than about 0.1 g per 100 ml of water at 20° C, and magnesium compounds which are insoluble in water, but substantially soluble in the presence of an ammonium ion, that is, magnesium compounds soluble in a bleaching solution or blix solution containing water soluble ammonium compounds (about 0.05 to about 2 mol/l) can also be used. Examples of magnesium compounds used in this invention are magnesium acetate, magnesium bromide, magnesium carbonate, magnesium chloride, magnesium citrate, magnesium hydroxide, magnesium lactate, magnesium nitrate, magnesium oxalate, magnesium oxide, magnesium perchlorate, magnesium secondary phosphate, magnesium tertiary phosphate, magnesium sulfate, magnesium silicate, magnesium bromate, magnesium sulfite, and magnesium chromate. Particularly useful magnesium compounds among these are magnesium acetate, magnesium bromide, magnesium chloride, and magnesium sulfate.

A suitable amount of the magnesium compound is about 0.01 to about 1 mol per liter of the bleach solution or blix solution.

In this invention, a water soluble addition product of an ammonium compound and a magnesium compound may be used in place of the water soluble compound and a magnesium compound. Typical examples of such water soluble addition products are as follows:

Magnesium ammonium sulfate ($(NH_4)_2SO_4 \cdot MgSO_4 \cdot 6H_2O$),

Magnesium ammonium chromate ($(NH_4)_2CrO_4 \cdot MgCrO_4 \cdot 6H_2O$),

Magnesium ammonium chloride ($NH_4Cl \cdot MgCl_2 \cdot 6H_2O$),

Magnesium ammonium carbonate ($(NH_4)_2CO_3 \cdot MgCO_3 \cdot 4H_2O$).

A suitable amount of the water soluble addition product is about 0.01 to about 1 mol per liter of the bleach solution or blix solution.

In addition, hardening agents which are conventionally used for processings may be added to the bleaching solution or blix solution of the invention, if desired. It should, however, be noted that the objects of the present invention cannot be attained by using the hardening agents conventionally used in place of the magnesium compounds of the invention.

The bleaching agent used in the bleaching solution or blix solution of the invention is a complex salt of an organic acid and a multivalent metal cation. Preferably, the bleaching agent is a metal complex salt of a polycarboxylic acid or a polyaminopolycarboxylic acid, and a metal cation having a higher multivalency of at least two different valencies and having a function of oxidizing metallic silver. Preferred examples of multivalent metal cations used in the invention are iron (III), cobalt (III), copper (II), etc., more particularly, iron (III).

The organic acids for the metal complex of the invention include a polycarboxylic acid and a polyaminopolycarboxylic acid. Preferred organic acids in accordance with the present invention are represented by the following formulae (at least one and up to all of the carboxyl groups thereof may be substituted by a water solubilizing group such as an alkali metal and/or an ammonium group):

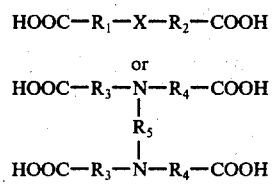

wherein X represents a hydrocarbon group, an oxygen atom, a sulfur atom, or — $NR_6$; $R_1$, $R_2$, $R_3$, $R_4$, and $R_5$ each represents a substituted or unsubstituted hydrocarbon group; and $R_6$ represents a hydrogen atom or a substituted or unsubstituted hydrocarbon group.

Among the organic acids shown by the above general formulae, aminopolycarboxylic acids are particularly useful. Examples of the organic acids used in this invention are malonic acid, tartaric acid, ethylmalonic acid, malic acid, fumaric acid, diglycollic acid, thioglycollic acid, nitrilotriacetic acid, ethylenediaminetetraacetic acid, aminotriacetic acid, ethylenedithioglycollic acid, dithioglycollic acid, diethylenetriaminepenetaacetic acid, ethyleneglycol bis(aminoethylether)tetraacetic acid, diaminopropanol tetraacetic acid, N-hydroxyethyl ethylenediaminetriacetic acid, ethyliminodipropionic acid, cyclohexanediaminetetraacetic acid, etc.

The aforementioned complex salts are described in German Pat. No. 866,605, British Pat. Nos. 746,567 and 933,008, and U.S. Pat. No. 3,582,322. That is, the complex salts of the organic acids and the metals described in these patents may be used in this invention.

Moreover, the above-mentioned organic acids easily form stable ferric chelate compounds with trivalent metal salts such as, for example, ferric chloride, ferric sulfate, and iron alum in an aqueous medium. Therefore, the organic acid and the trivalent iron salt may be used in an aqueous medium in this invention in place of using the complex salt thereof. The most generally used ferric complex salt of an organic acid is the ferric complex salt of ethylenediaminetetraacetic acid, which has a high bleaching power, is stable and is commercially available. In this invention, however, complex salts of organic acids and other metal salts than the aforesaid trivalent iron salts can also be employed.

It is preferred that the proportion of the metal complex salt of the organic acid in the bleach solution or blix solution of this invention be about 0.05 to about 1 mol per liter of the solution. When the complex salt is used at a high concentration, e.g., higher than about 60 g/l, the use of aqueous ammonia also improves the solubility of a complex salt.

Since a blix step is a combination of a bleach step and a fix step, a blix solution contains a silver halide solvent when the aqueous solution of this invention is employed as a blix solution. As the halide solvent, conventional compounds usually known as fixing agents can be used in this invention. Examples of such fixing agents (silver halide solvents) are a thiosulfate such as sodium thiosulfate, potassium thiosulfate, and ammonium thiosulfate; a thiocyanate such as sodium thiocyanate, potassium thiocyanate, and ammonium thiocyanate; a sulfur-containing organic secondary basic acid such as bisthioglycollic acid; an organic diol such as 3-thia-1,5-pentanediol; and imidazolidinethion. Blix solutions are also described in detail in the four patents above described. The amount of the bleaching agent in the blix solution can be as described before, i.e., about 0.05 to about 1 mol per liter, and the content of the fixing agent in the blix solution can be same as that of fixing agents used in conventional color photographic processing. Generally, the proportion of the fixing agent is about 0.1 to about 2 mols per liter of the solution. The bleach solution or the blix solution containing the fixing agent may further contain conventional additives such as a stabilization agent such as a sulfite, a metabisulfite, etc., and a pH buffer such as an acetate, a borate, etc.

The pH of the bleaching solution or blix solution of this invention can be widely varied, but preferably is not more than 8, more preferably about 5.0 to about 7.5. The pH of the bleach solution or the blix solution may be controlled using conventional pH controlling agents as are generally known in this art, such as a carbonate, an alkali hydroxide, hydrogen sulfite, etc. If the pH of the solution is too low, sometimes dyes in the color photographic images formed fade or precipitates form in the solution, while if the pH is too high, the solution is reduced in bleaching power.

The bleach solution or the blix solution used in this invention may also contain other conventional additives, e.g., a bleach accelerator such as potassium bromide, potassium iodide, sodium iodide, ammonium bromide, polyalkylene oxide, 2-mercaptoimidazole, 3-mercapto-1,2,4-triazole, dioctylglycol, a copper complex salt of an organic acid, a cobalt complex salt of an organic acid, thiourea, ethylenethiourea, water soluble selenium compounds, onium compounds as described in *The Journal of Photographic Science,* Vol. 19, No. 5, 113 - 120 (1971), a bleach fog preventing agent such as a hydroxylamine salt, p-aminophenol, hydroxymorpholine, ascorbic acid, 1-pyenyl-3-pyrazolidone, semicarbazide, the aminoethylquinones or the salts thereof as described in U.S. Pat. No. 3,671,259 or a hydrazine salt etc.

The bleach solution or the blix solution may still further contain other conventional additives as are generally known for such solutions in this art, e.g. a pH buffer, e.g., a nitrate such as sodium nitrate, a sulfite such as sodium sulfite, a mercapto compound such as mercaptotriazole, a borate, an oxalate, an acetate, a carbonate, and a phosphate; a stain preventing agent such as formamidine sulfinate, etc.; polyamine compounds as described in Japanese Pat. Publication No. 8836/1970; alkylamine compounds as described in British Pat. No. 1,192,481; iodides as described in German Pat. No. 1,127,715; polyethylene oxides as described in German Pat. No. 966,410; nitrogen-containing heterocyclic compounds as described in German Pat. No. 1,290,812; aldehyde group- or methylol group-containing water soluble compounds as described in Japanese Pat. Application (OPI) No. 42,733/1973; and water soluble optical whitening agents such as sodium 4-methyl-7-diethylaminocumarinsulfonate.

The bleach solution or the blix solution used in this invention is used at temperatures of from about 30° C to about 60° C. The bleach solution or the blix solution may be stored in the concentrated state, and, in such a case, the concentrated solution may be diluted at use.

The color developer used in the process of this invention is conventional and is an aqueous alkaline solution of an aromatic primary amine color developing agent, the pH of the developer being higher than about 8, preferably 9 to 12.5. Examples of the color developing agent are a phenylenediamine derivative such as N,N-diethyl-p-phenylenediamine sulfate, etc.; 4-amino-N-ethyl-N-β-hydroxyethylaniline sulfate; 3-methyl-4-amino-N-ethyl-β-methanesulfoamideethylaniline sesquisulfate monohydrate; 3-methyl-4-amino-N-ethyl-N-β-hydroxyethylaniline sulfate; and 3-methyl-4-amino-N,N-diethylaniline hydrochloride. Other examples of color developing agents as can be used in this invention are described in U.S. Pat. Nos. 2,193,015 and 2,592,364 and Japanese Patent Application (OPI) No. 64,933/1973.

The color developer used in this invention may further contain conventional additives for color developers such as an alkali metal salt of a sulfite, a carbonate, bisulfite, a bromide, an iodide, an antifoggant, a development accelerator, a solvent e.g., diethylene glycol, etc. Additives for color developers are described in U.S. Pat. Nos. 2,648,604, 3,671,247,2,533,990, 2,577,127, 2,950,970, 3,068,097, 2,496,940, 2,656,271, 3,113,864, 3,342,596, 3,295,976, 3,615,522, 3,295,976, 3,597,199, 3,161,513, 3,161,514, 3,536,487, British Patents 1,020,032, 1,020,033, 871,211, 1,030,442, 1,144,481, 1,251,558, and Japanese Patent Publication No. 41,675/1971.

The color photographic process of this invention may include other conventional processings such as stopping, image stabilization, neutralization, and black and white development in addition to color development and the bleaching and fixing or, alternatively, blixing.

The process of this invention can be applied to a color developing system where couplers are incorporated in color photographic materials as described in, for example, U.S. Pat. Nos. 2,376,679, 2,232,027, and 2,801,171 and also to a color development system where couplers are incorporated in color developers as described in U.S. Pat. Nos. 2,252,718, 2,592,243, and 2,590,970.

Furthermore, the process of this invention can be applied to the processing of general silver halide color photographic materials such as color photographic negative films, color photographic papers, color photographic positive films, color reversal films for slides, color reversal cinne films, color reversal TV films, etc.

As is well known, the various kinds of color photographic materials described above are processed in different manner. That is, the processing steps for color photographic negative films and color photographic positive films are generally composed of a color development, a stop-fixing, a bleaching, a fixing, a washing and a stabilization or a color development, a stop-fixing, a blixing, a washing, and a stabilization, the stop-fixing step sometimes being omitted. On the other hand, the processing steps for reversal color photographic materials are generally composed of a first development (or black and white development), a stop-hardening, a color development, a stop-hardening or a rinsing, a bleaching, a fixing (or a blix in place of the bleaching and fixing), a washing, and a stabilization. In the process, a pre-hardening and a neutralization are, as the case may be, often employed. Of course, these processes may be somewhat modified, but in any case according to the present invention, the bleach solution or the blix solution explained in this specification is employed. Thus, there is no particular limitation on the type of color development in this invention, or, in other words, the process of this invention can be applied to ordinary color development processes in which a bleach step or a blix step is employed. Therefore, with the practice of this invention the compositions of processing solutions known for these color processing steps can be used. Some of these examples are shown below, but the processing solutions employed in this invvention are not limited thereto.

For example, an aqueous solution containing a monomethyl p-aminophenol, a hydroquinone, and a 3-pyrazolidone as developing agents together with sodium sulfite, sodium sulfite, sodium carbonate, potassium bromide, potassium thiocyanate, etc., may be used as the first developer; an aqueous solution containing a thiosulfate, potassium metabisulfate, glacial acetic acid, etc., may be used as the stop-fixing solution; an aqueous solution containing potassium alum, sodium sulfate, boric acid, sodium acetate, glacial acetic acid, etc., may be used as the stop-hardening solution; an aqueous solution containing potassium metabisulfite, etc., may be used as the rinsing solution; an aqueous solution containing formalin, a surface active agent, etc., may be used as the stabilization solution; an aqueous solution containing formalin, sodium sulfate, 2,5-dimethoxytetrahydrofuran, potassium bromide, etc., may be used as the pre-hardening solution, and an aqueous solution containing sodium acetate, potassium metabisulfite, sodium sulfate, glacial acetic acid, etc., may be used as the neutralization solution. The color development process of this invention can be performed under conventional conditions (including high temperature processing).

The process of this invention can be applied to various kinds of color photographic materials as mentioned before. Now, each element of color photographic materials processed according to the process of this invention will be generally explained.

The silver halide emulsion employed is a dispersion of a silver halide such as silver chloride, silver bromide, silver iodide, silver chlorobromide, silver iodobromide, and silver chloroiodobromide in a hydrophilic colloid such as gelatin, and the silver halide emulsion may contain conventional photographic additives such as a sensitizer, a sensitizing dye, a coupler, a stabilizer, an antifoggant, a hardening agent, etc.

Examples of chemical sensitizers used as a sensitizer for the silver halide emulsion are gold compounds such as auric chloride and gold trichloride as described in U.S. Pat Nos. 2,399,083 and 2,540,085; salts of noble metals such as platinum, palladium, iridium, rhodium, and ruthenium as described in U.S. Pat. Nos. 2,448,060 and 2,540,086; sulfur compounds capable of forming silver sulfides by reaction with silver salts as described in U.S. Pat. No. 1,574,944, etc.; and stannous salts, amines and reducing materials as described in U.S. Pat. Nos. 2,487,850 and 2,518,698.

The silver halide photographic emulsion can be spectrally sensitized or super-sensitized by a cyanine dye such as a cyanine, merocyanine, carbocyanine, etc., dye or a combination of cyanine dyes or further by the combination of a cyanine dye and a styryl dye. Such sensitization techniques are well known and are described in, for example, U.S. Pat. Nos. 2,493,748, 3,672,897, 2,688,545, and 3,628,964, British Pat. Nos. 1,195,302 and 1,293,862, German Pat. No. 2,030,326, Japanese Pat. Publication No. 4936/1968, U.S. Pat. Nos. 3,511,664, 3,635,721, and 3,694,217, and British Pat.

Nos. 1,137,580 and 1,216,203. The technique may be selected according to the wavelength regions and sensitivity to be sensitized and the purpose and end use of the photographic material.

When the color photographic materials of this invention contain therein dye image forming couplers, the silver halide emulsion layers sometimes contain so-called non-diffusible couplers. Examples of such useful couplers include 4-equivalent diketomethylene yellow couplers and 2-equivalent yellow couplers such as the compounds described in U.S. Pat. Nos. 3,277,157, 3,415,652, 3,447,928, 3,311,476, and 3,408,194, the compounds described in U.S. Pat. Nos. 2,875,057, 3,265,506, 3,409,439, 3,265,506, 3,409,439, 3,551,155, and 3,551,156, and the compounds described in Japanese Pat. Application (OPI) Nos. 26,133/1972 and 66,836/1974, 4-equivalent pyrazolone couplers and 2-equivalent pyrazolone magenta couplers such as the compounds described in U.S. Pat. Nos. 2,600,788, 2,983,608, 3,006,759, 3,062,653, 3,214,437, 3,253,924, 3,419,391, 3,419,808, 3,476,560, and 3,582,322, Japanese Pat. Publication No. 20,636/1970 and Japanese Patent Application (OPI) No. 26,133/1972, and α-naphthol cyan couplers and phenol cyan couplers such as the compounds described in U.S. Pat. Nos. 2,474,293, 2,698,794, 3,034,892, 3,214,437, 3,253,924, 3,311,476, 3,458,315, 3,591,383, and Japanese Pat. Publication Nos. 11,304/1967 and 32,461/1969. Furthermore, development inhibitor releasing couplers as described in U.S. Pat. Nos. 3,227,554, 3,287,445, 3,253,924, 3,311,476, 3,379,529, 3,516,831, 3,617,291 and 3,705,801, and German Pat. No. 2,163,811 can also be used. The couplers can be dispersed by the process as described in, for example U.S. Pat. No. 2,801,171.

It is known to add 4-hydroxy-6-methyl-1,3,3*a*,7-tetraazaindene, 3-methyl-benzothiazole, 1-phenyl-5-mercaptotetrazole as well as various heterocyclic compounds, mercury-containing compounds, mercapto compounds, and metal salts to photographic emulsions to prevent a reduction in sensitivity and the formation of fog during the production thereof or during storage of the photographic emulsions or photographic materials produced therefrom. Examples of such additives are described in C. E. K. Mees, *The Theory of the Photographic Process,* 3rd Edition, 1966, citing original literature, as well as in U.S. Pat. Nos. 1,758,576, 2,697,040, 2,444,605, 2,566,245, 2,728,663, 2,943,491, 3,226,231, 3,420,668 and British Patents 893,428 and 1,200,188.

Surface active agents may be added to the photographic emulsion individually or as a mixture thereof. Surface active agents are usually used as a coating aid but can also be used, in some cases, for other purposes such as for emulsifying dispersion, sensitization, improvement of photographic characteristics, antistatic effects, sticking prevention, etc. Examples of such surface active agents are natural surface active agents such as saponin; nonionic surface active agents such as alkylene oxide type surface active agents, glycerin type surface active agents, and glycidol type surface active agents; cationic surface active agents such as higher alkylamines, quaternary ammonium salts, pyridine and other heterocyclic compounds, phosphonium compounds, and sulfonium compounds, anionic surface active agents containing acid groups such as carboxylic, sulfonic, phosphoric, sulfuric acid ester, or phosphoric groups; and amphoteric surface active agents such as amino acids, aminosulfonic acids, sulfuric acid esters of amino alcohols, and phosphoric acid esters of amino alcohols.

Many of such surface agents are described in, for example, U.S. Pat. Nos. 2,271,623, 2,739,891, 3,294,540, 3,442,654, and 3,545,974, German Pat. No. 1,942,665, and British Pat. Nos. 1,077,317 and 1,198,450. as well as in Ryohei Oda, *Synthesis and the Application of Surface Active Agents,* published by Maki Shoten (1964); A. W. Perry, *Surface Active Agents,* 1958, published by Interscience Publications, and J. P. Sisley, *Encyclopedia of Surface Active Agents,* Vol. 2, 1964, published by Chemical Publishing Company.

The photographic emulsion may also be hardened in a conventional manner. Examples of hardening agents are aldehyde compounds such as formaldehyde and glutaraldehyde; ketone compounds such as diacetycyclopentadione; bis(2-chloroethylurea); 2-hydroxy-4,6-dichloro-1,3,5-triazine; the reactive halogen-containing compounds as described in U.S. Pat. Nos. 3,288,775 and 2,732,303 and British Pat. Nos. 974,723 and 1,167,207; divinylsulfone; 5-acetyl-1,3-diacryloylhexahydro-1,3,5-triazine; the reactive olefin-containing compounds as described in U.S. Pat Nos. 3,635,718 and ;b 3,232,763 and British Pat. No. 994,869; N-hydroxymethylphthalimide; the N-methylol compounds as described in U.S. Pat. Nos. 2,732,316 and ;b 2,586,168; the isocyanates as described in U.S. Pat. No. 3,103,437; the aziridine compounds as described in U.S. Pat. Nos. 3,017,280 and 2,983,611; the acid derivatives as described in U.S. Pat. Nos. 2,725,294 and 2,725,295; the carbodiimide compounds as described in U.S. Pat. No. 3,100,704; the epoxy compounds as described in U.S. Pat. No. 3,091,537; the isoxazole compounds as described in U.S. Pat. Nos. 3,321,313 and 3,543,292; halogenocarboxyaldehydes such as mucochloric acid; dioxane derivatives such as dihydroxydioxane, dichlorodioxane, etc.; and inorganic hardening agents such as chromium alum, zirconium sulfate, etc. In place of the aforementioned compounds, precursors for these compounds, such as an alkali metal bisulfite-aldehyde addition product, a methylol derivative of hydantoin, and primary aliphatic nitro alcohols may be used.

In the case of the hardening agent, it is often preferred to use an aldehyde compound.

The photographic emusions are coated on a conventional support which does not undergo substantial dimensional changes during processing, such as a cellulose nitrate film, a cellulose acetate film, a cellulose acetate butyrate film, a cellulose acetate propionate film, a polystyrene film, a polyethylene terephthalate film, a polycarbonate film, a laminate of these films, a thin glass sheet, paper, etc. Baryta coated paper, paper coated with an α-olefin polymer such as polyethylene, polypropylene, an ethylene-butene copolymer, etc., and a plastic film the surface of which has been matted to improve its adhesion to other polymers and to improve printability as described in Japanese Pat. Publication No. 19,068/1972 can be effectively used as supports for the phototgraphic emulsions. A transparent support or an opaque support can be used according to the purpose of the color photographic materials. When a transparent support is used, colorless transparent support as well as transparent supports colored with dyes or pigments can be used. The use of a colored transparent film has been practiced in, for example, X-ray films, and is described in J.S.M.P.T.E., 67 296 (1958).

As opaque supports, there are papers which are essentially opaque as well as plastic films which were made opaque by the addition of dyes or titanium oxide, plastic films the surfaces of which were treated by the process described in Japanese Patent Publication No. 19,068/1972, papers having added thereto carbon black, etc., to render them completely light-shading, and plastic films having added thereto carbon black, etc. When the support shows insufficient adhesion to photographic emulsion layers, a layer having good adhesion to both the support and the photographic emulsion layers is formed on the surface of the support as a subbing layer. Furthermore, to improve the adhesion of the support, the surface of the support may be subjected to a pretreatment such as a corona discharge, ultraviolet irradiation, or a flame treatment.

The photographic emulsion layers can be coated on the support by various coating manners including dip coating, air knife coating, curtain coating, and extrusion coating using a hopper as described in U.S. Pat. No. 2,681,294. If desired, two or more photographic emulsion layers may be formed simultaneously on the support in the manner described in U.S. Pat. Nos. 2,761,791, 3,508,947, 2,941,898, and 3,526,528.

The layer construction of color photographic materials processed by the process of this invention will be illustrated below, but it should be understood that the color photographic films processed by the process of this invention are not limited to those examples.

A color photographic negative film or a color reversal film is generally composed of a transparent support such as a cellulose triacetate film or a polyethylene terephthalate film having coated in succession thereon an antihalation layer, a red sensitive silver halide emulsion layer containing a cyan coupler, a green sensitive silver halide emulsion layer containing a magenta coupler, a yellow filter layer, a blue sensitive silver halide emulsion layer containing a yellow coupler, and a gelatin protective layer.

On the other hand, a color photographic paper is generally composed of an opaque support such as a baryta coated paper or a resin coated paper having coated in succession thereon a blue sensitive silver halide emulsion layer containing a yellow coupler, a green sensitive silver halide emulsion layer containing a magenta coupler, a red sensitive silver halide emulsion layer containing a cyan coupler, and a gelatin protective layer.

Moreover, a color photographic positive film is generally composed of a transparent support such as a cellulose triacetate film or a polyethylene terephthalate film having a black resin backing layer having coated (on the opposite side thereof) in succession thereon a blue sensitive silver halide emulsion layer containing a yellow coupler, a red sensitive silver halide emulsion layer containing a cyan coupler, a green sensitive silver halide emulsion layer containing a magenta coupler, and a gelatin protective layer.

Still further, a so-called mixed packet type color photographic material can be used in the process of this invention. That is, a color photographic material having a single emulsion layer containing a mixture of packets containing a blue sensitive emulsion and a yellow coupler, packets containing a green sensitive emulsion and a magenta coupler, and packets containing a red sensitive emulsion and a cyan coupler can also be processed by the process of this invention.

The merits obtained by the process of this invention are as follows:

1. It is difficult in the conventional high temperature processing of color photographic materials to harden the photographic materials in a bleach solution or a blix solution containing a metal complex salt of an organic acid as the bleaching agent, but according to the process of this invention, the hardening of color photographic materials in such a bleach solution or blix solution in high temperature processing is possible. For example, when a color photographic negative film was processed in a bleach solution containing an iron (III) complex salt of ethylenediaminetetraacetic acid and ammonium bromide together with 0.1 mol/l of the magnesium compound shown below, bleaching could be performed at the elevated temperatures as shown below without surface problems such as reticulation.

| Additive | Processing temperature |
|---|---|
| | (° C) |
| None | 40 |
| Magensium sulfate | 52 |
| Magnesium hydroxide | 54 |
| Magnesium nitrate | 55 |
| Magnesium acetate | 56 |
| Magnesium bromide | 55 |
| Magnesium chloride | 56 |

On the other hand, when 4 ml/l of formalin was added to the bleach solution in place of the magnesium compound in a conventional manner, bleach processing at 44° C led to the formation of reticulation.

2. The bleach solution or the blix solution used in this invention is stable. When an aldehyde compound such as formaldehyde is incorporated in a bleach solution or blix solution in a conventional manner, precipitates form during storage of the solution to reduce the hardening power of the solution, but, when the bleach solution or blix solution of this invention is stored for a long period of time, no precipitate forms and the solution maintains its hardening power. Furthermore, even when a color developer, etc., containing a carbonate or an alkali hydroxide enters the bleach solution or blix solution of this invention, the solution does not form a precipitate of slightly water soluble compounds and it maintains its hardening power. Still further, when a carbonate or an alkali hydroxide is incorporated in the bleach solution or the blix solution of this invention to control the pH thereof, the solution maintains its hardening power without forming precipitates for long periods of time. Thus, in the case of using the bleach solution or blix solution of this invention, color photographic materials can be finished without the formation of spots and scratches by the action of such precipitates.

3. The process of this invention is not accompanied by pollution problems. That is, a bleaching solution or a blix solution containing potassium ferricyanate or potassium dichromate as the bleaching agent causes pollution problems and treatment of spent solution containing such a bleaching agent is difficult, while the treatment of the spent bleach solution or blix solution of this invention can be easily carried out as the solution contains a metal complex salt of organic acid which can easily be treated to avoid environmental pollution.

4. The bleach solution or blix solution of this invention can be regenerated after use. That is, since the metal complex salt of an organic acid in the spent solution after processing can be easily regenerated by blowing air or oxygen into the spent solution, the solution can be reused merely by supplying make-up components, which makes the process of this invention economically profitable. The spent solution may also be regenerated by other methods than the above, for example, the process described in U.S. Pat. No. 3,634,088 in which after removing silver ions from the spent blix solution it is regenerated by the oxidative action of oxygen, and the process as described in U.S. Pat. No. 3,813,246 in which a spent blix solution is brought into contact with oxygen by spraying it into an oxygen atmosphere to reoxidize the solution may be employed.

5. The time required for drying color photographic material processed according to the process of this invention can be shortened. When a color photographic material processed in a conventional blix solution is washed with water, the photographic emulsion layers of the photographic material rapidly swell to increase the water content in the emulsion layers, and the extent of swelling influences the drying time. The extent of swelling is reduced when magnesium ions are present in the washing water, and, hence, the water content of the emulsion layer is reduced, which shortens the drying time.

In the case of washing the color photographic materials processed in the bleach solution or the blix solution according to the process of this invention, the washing treatment is carried out in the presence of magnesium ions due to the magnesium compound remaining in the photographic emulsion layers and carried by the photograhic material into the washing water from the bleach or blix solution, and, thus, swelling of the emulsion layers is restrained and the water content in the emulsion layers becomes less. Thus, the drying time in the process of this invention is shortened to about 60 to 70% of that following conventional washings with washing water of moderate hardness. Also, when a color photographic material processed in the bleach solution or blix solution of this invention is washed with hard water containing magnesium salts or calcium salts, precipitates of insoluble materials are not formed due to the water soluble ammonium compound carried in the washing water in the process of this invention, and, thus, there occur no problems such as the formation of scratches on the surface of emulsion layer in this invention.

Furthermore, since the emulsion layers of the color photographic material processed according to the process of this invention are effectively hardened, the color photographic material can be dried without melting of the emulsion layers even if the drying operation is carried out at higher temperatures, and, hence, the drying time can be reduced to below ½ of the drying time in conventional processes.

Having thus generally described the invention, the following examples are given to illustrate currently preferred ways of practicing the present invention.

EXAMPLE 1

A color photographic negative film was prepared by coating in succession on a cellulose triacetate film base a black antihalation layer, a red sensitive silver iodobromide emulsion layer (dry thickness: 7 microns) containing 5.3 g/m² of gelatin and 1.8 g/m² of 1-hydroxy-4-[α-(2-hexyldecyloxycarbonyl)phenylazo]-2-[N-(1-naphthyl)naphthamide, a green sensitive silver iodobromide emulsion layer (dry thickness: 6 microns) containing 4.6 g/m² of gelatin and 1.1 g/m² of 1-(2,4,6-trichlorophenyl)-3-[3-(2,4-di-tert-amylphenoxyacetamido)-benzamido]4-(methoxyphenylazo)-5-pyrazolone, a blue sensitive silver iodobromide emulsion layer (dry thickness: 5 microns) containing 2.7 g/m² of gelatin and 1.5 g/m² of 5-[α-(2,4-di-tert-amylphenoxy)acetamido]-(4-methoxybenzoyl)acetanilide, and a gelatin protective layer containing 1.5 g/m² of gelatin (where the silver iodobromide emulsions described above each contained 5 mol% of silver iodide) and the color negative film was exposed through a step wedge to a tungsten lamp and developed according to the following steps:

| | Temperature (° C) | Time (min) |
|---|---|---|
| 1. Color development | 46 | 1.5 |
| 2. Bleach | 44 - 46 | 2 |
| 3. Wash | 40 - 46 | 1 |
| 4. Fix | 44 - 46 | 2 |
| 5. Wash | 40 - 46 | 1.5 |
| 6. Stabilization | 20 - 30 | 0.5 |
| 7. Drying | 45 - 50 | 3 - 5 |

The compositions of the processing solutions used in the above development processing were as follows:

| | | |
|---|---|---|
| Color developer | | |
| Sodium hexametaphosphate | 2 | g |
| Anhydrous sodium sulfite | 2 | g |
| Sodium hydrogen carbonate | 8 | g |
| Sodium hydrogen sulfate | 7 | g |
| Potassium bromide | 1.8 | g |
| Anhydrous sodium carbonate | 30 | g |
| Hydroxylamine sulfate | 3 | g |
| 4-Amino-N-ethyl-N-β-hydroxyethyl-3-toluidine sulfate monohydrate | 2.6 | g |
| Water to make | 1 | l |
| Bleach solution A | | |
| Ethylenediaminetetraacetic acid iron (III) complex salt | 100 | g |
| Potassium bromide | 50 | g |
| Aqueous ammonia (28%) | 6 | ml |
| Water to make | 1 | l |
| Bleach solution B | | |
| Ethylenediaminetetraacetic acid iron (III) complex salt | 100 | g |
| Ammonium bromide | 80 | g |
| Aqueous ammonia (28%) | 6 | ml |
| Magnesium sulfate | 20 | g |
| Water to make | 1 | l |
| Fix solution | | |
| Ammonium thiosulfate | 120 | g |
| Anhydrous sodium sulfite | 20 | g |
| Sodium metabisulfite | 20 | g |
| Water to make | 1 | l |
| Stabilization solution | | |
| Aqueous solution of polyethylene glycol (40 wt % present; mean molecular weight: 400) | 10 | ml |
| 37% Formalin | 6 | ml |
| Water to make | 1 | l |

The results obtained by processing 50 strips of 35 × 120 mm for sensitometry per liter of the solution are shown in the following Table.

| Characteristics | Bleach Solution Solution A | Bleach Solution Solution B |
|---|---|---|
| Photographic properties | good | good |
| Reticulation | observed | none |
| Precipitates in soln. | none | none |
| Drying time | 15 min at 40° C | 3 min at 50° C |

As shown in the above Table, when the color films were processed in Bleach solution B according to this invention, reticulation was not observed and drying could be finished in a shorter period of time.

EXAMPLE 2

A color photographic paper was prepared by coating in succession on a polyethylene coated paper as described in U.S. Pat. No. 3,448,000 a blue sensitive silver chlorobromide (Br content: 80mol%) emulsion layer containing 1.2 g/m² of gelatin and 0.3 g/m² of α-(4-carboxyphenoxy)-α-pivaloyl-2-chloro-5-[α-(2,4-di-tert-amylphenoxy)butyramido acetanilide, a green sensitive silver chlorobromide (Br content: 50 mol%) emulsion layer containing 1.2 g/m² of gelatin and 0.3 g/m² of 1-(2,4-dichloro-6-methoxyphenyl)-3-[3-tridecanoylamido-6-chloro)-anilino]-4-benzyloxycarbonyloxy-5-pyrazolone, a red sensitive silver chlorobromide (Br content: 50 mol%) emulsion layer containing 1.0 g/m² of gelatin and 0.4 g/m² of 5-methyl-4,6-dichloro-2-[α-(3-n-pentadecylphenoxy)butyramino]-phenol, and a gelatin protective layer containing 1.0 g/m² of gelatin, and the color paper thus prepared was exposed through an optical wedge by means of a sensitometer and then developed by the following processing.

| | Temperature (° C) | Time (min) |
|---|---|---|
| 1. Color development | 40 | 2 |
| 2. Blix | 38 – 40 | 1 |
| 3. Wash | 32 – 40 | 1 |
| 4. Drying | 80 | 1 |

The compositions of the processing solutions used in the above processing were as follows:

| | | |
|---|---|---|
| Color developer | | |
| Hydroxylamine sulfate | 2 | g |
| Anhydrous sodium sulfite | 2 | g |
| Anhydrous potassium carbonate | 30 | g |
| Potassium bromide | 0.4 | g |
| 50 wt% Aqueous solution of benzyl alcohol | 30 | ml |
| 4-Amino-N-ethyl-N-(β-metasulfonamido-ethyl)-m-toluidine sesquisulfate Monohydrate | 4.4 | g |
| Water to make | 1 | l |
| Blix solution C | | |
| Ethylenediaminetetraacetic acid iron (III) complex salt | 40 | g |
| Ethylenediaminetetraacetic acid disodium salt | 4 | g |
| Anhydrous sodium carbonate | 3 | g |
| 70 wt% Aqueous solution of ammonium thiosulfate | 120 | ml |
| Anhydrous sodium sulfite | 8 | g |
| Magnesium chloride | 10 | g |
| Water to make | 1 | l |
| Blix solution D | | |
| Ethylenediaminetetraacetic acid iron (III) complex salt | 40 | g |
| Ethylenediaminetetraacetic acid disodium salt | 4 | g |
| Anhydrous sodium carbonate | 3 | g |
| Sodium thiosulfate ($5H_2O$) | 200 | g |
| Anhydrous sodium sulfite | 8 | g |
| Magnesium ammonium chloride | 30 | g |
| Water to make | 1 | l |
| Blix solution E | | |
| Ethylenediaminetetraacetic acid iron (III) complex salt | 40 | g |
| Ethylenediaminetetraacetic acid disodium salt | 4 | g |
| Sodium thiosulfate ($5H_2O$) | 200 | g |
| Anhydrous sodium sulfite | 8 | g |
| Magnesium chloride | 10 | g |
| Water to make | 1 | l |

The results obtained by processing 50 strips of 35 × 120 mm for sensitometry per liter of the solution are shown in the following Table.

| Characteristics | Blix Solution Solutions C and D | Blix Solution Solution E |
|---|---|---|
| Photographic properties | good | good |
| Reticulation | none | observed |
| Precipitates in soln. | none | observed |
| Drying time | 1 min | 2 min |

As shown in the above Table, when the color papers were processed in blix solution E containing the magnesium compound without a water soluble ammonium compound, precipitates formed in the solution and the hardening power of the blix solution was reduced as well as the drying time being prolonged as compared to processing using blix solutions C and D containing both components according to the teaching of this invention.

EXAMPLE 3

A color reversal film was prepared by coating in succession on a cellulose triacetate film base a black antihalation layer, a red sensitive silver iodobromide emulsion layer (dry thickness: 2.4 microns) containing 1.4 g/m² of gelatin and 0.7 g/m² of 1-hydroxy-4-chloro-N-dodecyl-2-naphthamide, a green sensitive silver iodobromide emulsion layer (dry thickness: 3.0 microns) containing 1.9 g/m² of gelatin and 0.9 g/m² of 1-(2,4,6-trichlorophenyl)-3-[3-(N-butyltetradecane-amido-propaneamido]pyrazoline-5-one, a yellow filter layer (dry thickness: 0.9 micron) containing 1.0 g/m² of gelatin, a blue sensitive silver iodobromide emulsion layer (dry thickness: 4.0 microns) containing 2.2 g/m² of gelatin and 1.3 g/m² of 4-benzoylacetamido-N-butyl-N-octylbenzoamide, and a gelatin protective layer (dry thickness: 0.9 micron) containing 0.9 g/m² of gelatin (where the silver iodobromide emulsions used in Example 3 each contained silver iodide of 2.5 mol% and silver chloride of 0.1 mol%) and the color reversal film thus prepared was exposed through an optical wedge by means of a sensitometer and processed by the following processings:

| | Temperature (° C) | Time (min) |
|---|---|---|
| 1. First development | 50 | 1 |
| 2. Stop | 48 – 50 | 0.5 |
| 3. Wash | 44 – 50 | 1 |
| 4. Color development | 50 | 2 |
| 5. Bleach | 48 – 50 | 1 |
| 6. Fix | 48 – 50 | 1 |
| 7. Wash | 44 – 50 | 1 |
| 8. Stabilization | 30 – 50 | 0.5 |
| 9. Drying | 50 | 1.5 |

The composition of the processing solutions used in the above processings were as follows:

| | | |
|---|---|---|
| First developer | | |
| Sodium hexametaphosphate | 2 | g |
| Sodium hydrogen sulfite | 8 | g |
| 1-Phenyl-3-pyrazolidone | 0.35 | g |
| Anhydrous sodium sulfite | 37 | g |
| Hydroquinone | 5.5 | g |
| Sodium thiocyanide | 1.4 | g |
| Sodium bromide | 1.3 | g |
| 0.1 wt% Aqueous solution of potassium iodide | 13 | ml |
| 25 wt% Aqueous solution of glutaraldehyde | 20 | ml |
| Water to make | 1 | l |
| Stop solution | | |
| Sodium acetate | 3.4 | g |
| Glacial acetic acid | 27.5 | ml |
| Water to make | 1 | l |
| Color developer | | |
| Anhydrous sodium sulfite | 2 | g |

-continued

| | | |
|---|---|---|
| Sodium hydroxide | 10 | g |
| Borax pentahydrate | 30 | g |
| Sodium bromide | 1 | g |
| Anhydrous sodium sulfate | 100 | g |
| N-ethyl-N-(β-oxyethyl)-p-phenylenediamine sulfate | 5 | g |
| Tertiary butylaminoborane | 0.1 | g |
| Water to make | 1 | l |
| Bleach solution F | | |
| Ammonium bromide | 150 | g |
| Ethylenediaminetetraacetic acid iron (III) complex salt | 110 | g |
| Aqueous ammonia (28 wt%) | 8 | ml |
| Ammonium nitrate | 40 | g |
| Magnesium acetate | 30 | g |
| Magnesium bromide 20 | g | |
| Water to make | 1 | l |
| Fix solution | | |
| Ammonium thiosulfate | 200 | g |
| Anhydrous sodium sulfite | 17 | g |
| Sodium hydrogen sulfite | 5 | g |
| Water to make | 1 | l |

STABILIZATION SOLUTION

Same as used in Example 1.

The results showed that when such high temperature rapid processing was carried out, no reticulation was formed and no precipitates formed in the blix solution or in washing water.

While the invention has been described in detail and with reference to specific embodiments thereof, it will be apparent to one skilled in the art that various changes and modifications can be made therein without departing from the spirit and scope thereof.

What is claimed is:

1. A process of bleaching or blixing silver halide color photographic materials which comprises processing exposed and color developed photographic materials in a bleach solution or a blix solution having a pH of from 5.0 to 7.5 containing an iron III, cobalt III or copper II complex salt of an organic acid, a water soluble ammonium compound and a magnesium compound selected from the group consisting of magnesium acetate, magnesium bromide, magnesium chloride, magnesium sulfate, magnesium carbonate, magnesium citrate, magnesium hydroxide, magnesium lactate, magnesium nitrate, magnesium oxalate, magnesium oxide, magnesium perchlorate, magnesium secondary phosphate, magnesium tertiary phosphate, magnesium silicate, magnesium bromate, magnesium sulfite, or magnesium chromate.

2. The process as set forth in claim 1 in which said bleach solution or blix solution contains about 0.05 to about 1 mol of said complex salt of the organic acid, about 0.05 to about 2 mols of the water soluble ammonium compound, and about 0.01 to about 1 mol of the magnesium compound per liter of the solution.

3. The process as set forth in claim 1 in which said blix solution further contains about 0.1 to about 2 mols of a fixing agent per liter of the solution.

4. The process as set forth in claim 1 in which said bleach solution or blix solution contains about 0.05 to about 1 mol of the metal complex salt of the organic acid and about 0.01 to about 1 mol of an addition product of the water soluble ammonium compound and the magnesium compound per liter of the solution.

5. The process as set forth in claim 4 in which said blix solution further contains about 0.1 to about 2 mols of a fixing agent per liter of the solution.

6. The process as set forth in claim 1 in which said processing is carried out at a high temperature above about 30° C.

7. The process as set forth in claim 1 in which said water soluble ammonium compound is ammonium chloride, ammonium thiosulfate, ammonium acetate, or aqueous ammonia.

8. The process as set forth in claim 4 in which said addition product is magnesium ammonium sulfate, magnesium ammonium chromate, magnesium ammonium chloride, or magnesium ammonium carbonate.

9. The process as set forth in claim 1 in which said complex salt is a ferric complex salt of the organic acid.

10. The process as set forth in claim 9 in which said ferric complex salt is the ferric complex salt of ethylenediaminetetraacetic acid.

11. The process as set forth in claim 1, in which said water soluble ammonium compound is selected from the group consisting of ammonium tartarate, ammonium hydrogen tartarate, ammonium benzoate, ammonium borate, ammonium iodide, ammonium bromide, ammonium alum, ammonium bichromate ammonium carbonate, ammonium chloride, ammonium hydroxide, ammonium persulfate, ammonium sulfide, ammonium thiocyanate, ammonium thiosulfate, ammonium citrate, ammonium formate, ammonium metabisulfite, ammonium bromate, ammonium oxalate, ammonium acetate, ammonium hydrogen carbonate, ammonium sulfite, ammonium nitrate, ammonium sulfate or aqueous ammonia.

12. The process as set forth in claim 1, in which said magnesium compound is selected from the group consisting of magnesium acetate, magnesium bromide, magnesium chloride, or magnesium sulfate.

13. The process as set forth in claim 1, in which said organic acid is a polycarboxylic acid or a polyaminopolycarboxylic acid.

14. The process as set forth in claim 1, in which said organic acid is an organic acid represented by the following formulae:

$$\mathrm{HOOC{-}R_1{-}X{-}R_2{-}COOH}$$

$$\mathrm{HOOC{-}R_3{-}\underset{\underset{R_5}{|}}{N}{-}R_4{-}COOH}$$

$$\mathrm{HOOC{-}R_3{-}\underset{\underset{R_5}{|}}{N}{-}R_4{-}COOH.}$$

15. The process of claim 6, wherein said temperature is about 40° to 56° C.

* * * * *